US005976282A

United States Patent [19]

Fukuda et al.

[11] Patent Number: 5,976,282

[45] Date of Patent: Nov. 2, 1999

[54] METHOD FOR PRODUCING AUSTENITIC STEEL PLATE WITH EXCELLENT SURFACE BRIGHTNESS AND CORROSION RESISTANCE

[75] Inventors: Kunio Fukuda; Yoshikazu Kawabata; Kazuhide Ishii; Susumu Sato, all of Chiba, Japan

[73] Assignee: Kawasaki Steel Corporation, Hyogo-ken, Japan

[21] Appl. No.: 09/156,599

[22] Filed: Sep. 18, 1998

Related U.S. Application Data

[62] Division of application No. 08/823,019, Mar. 21, 1997, abandoned.

[30] Foreign Application Priority Data

Mar. 22, 1996 [JP] Japan ..... 8-66584
May 2, 1996 [JP] Japan ..... 8-111536

[51] Int. Cl.[6] ..... C21D 8/02

[52] U.S. Cl. ..... 148/606; 148/609; 148/610

[58] Field of Search ..... 148/609, 610, 148/606

[56] References Cited

U.S. PATENT DOCUMENTS 5,830,291 11/1998 McGuire et al. ..... 148/606

FOREIGN PATENT DOCUMENTS

| | | | |
|---|---|---|---|
| 38-12162 | 12/1958 | Japan . | |
| 62-60164 | 12/1981 | Japan . | |
| 59-59900 | 4/1984 | Japan . | |
| 3-60920 | 12/1985 | Japan . | |
| 61-96092 | 5/1986 | Japan | 148/606 |
| 405163587 | 6/1993 | Japan | 148/606 |
| 6-017271 | 1/1994 | Japan . | |
| 6-088297 | 3/1994 | Japan . | |
| 6-088300 | 3/1994 | Japan . | |
| 6-280064 | 10/1994 | Japan . | |
| 7-26350 | 1/1995 | Japan . | |
| 7-113187 | 4/1995 | Japan . | |

*Primary Examiner*—Deborah Yee
*Attorney, Agent, or Firm*—Young & Thompson

[57] ABSTRACT

An austenite stainless steel plate having both excellent surface brightness and superior corrosion resistance, without polishing after finish annealing and pickling for descaling of the strip. The steel plate contains Si 0.02 to 0.2 wt % together with Si oxides at 1.0 wt % or less in the surface layer part in the 10 μm depth from the surface. The depth of the intergranular groove in the surface layer part is 0.1 μm or more to 0.5 μm or less. Furthermore, the steel plate contains Al of 0.005 wt % or less and 0 of 0.006 wt % or less. The Al oxides are contained at 0.1 wt % or less in the surface layer part in the 10 μm depth from the surface.

6 Claims, 1 Drawing Sheet

METHOD FOR PRODUCING AUSTENITIC STEEL PLATE WITH EXCELLENT SURFACE BRIGHTNESS AND CORROSION RESISTANCE

CROSS-REFERENCE TO RELATED APPLICATIONS

This application is a division of application Ser. No. 08/823,019, filed Mar. 21, 1997, now abandoned.

BACKGROUND OF THE INVENTION

1. Field of the Invention

The present invention relates to an austenite stainless steel plate with excellent surface brightness and corrosion resistance.

2. Description of the Prior Art

Because austenite stainless steel plate represented by SUS 304 has excellent thermal resistance, corrosion resistance, processability and the like, the steel plate has been put to a variety of uses with attention focused on the characteristic properties thereof. For producing a cold-rolled steel strip from the austenite stainless steel slab, generally, annealing is carried out after cold rolling at the finish process, to prepare the steel strip with specified properties, depending on the use.

The annealing process at the finish process is carried out in strongly reducing atmosphere or in combustive gas atmosphere. The former process is called bright annealing (BA), and the oxidized film (scale) formed on the steel strip surface by such annealing is so extremely thin that the surface brightness remaining on the material immediately after rolling out can be retained practically as it is. Because $H_2$ and $N_2$ gases in mixture are used in the atmosphere, however, the equipment therefor gets complex, which disadvantageously makes such annealing costly. On the other side, by the latter process, a relatively thick scale layer is generated during annealing, and therefore, the resulting steel plate at such state adversely affects the corrosion resistance and the die life during forming. Thus, pickling is indispensable for descaling in case that annealing is carried out in the combustive gas atmosphere by the latter process. Consequently, the surface brightness of the finished plate is poorer than the rolled-out surface.

As to the pickling, a great number of research works have been conducted conventionally, with a lot of technical references in publication. For example, Japanese Patent Publication No. Sho 38-12162, Japanese Patent Laid-open No. Sho 59-59900 or Stainless Steel Guide Book (edited by Masayoshi Hasegawa, ed., published by Nikkan Industrial Newspaper, 1973, p.839) discloses a so-called salt process comprising immersing the annealed steel strip in an alkali molten salt or a method comprising an electrolytic process of the annealed steel strip in a neutral salt solution and a subsequent immersion process of the resulting strip in an acid solution such as sulfuric acid, nitric acid, and nitrate salt or a subsequent electrolytic process of the strip.

At the pickling process for the descaling of austenite stainless steel strip, conventionally,an acid mixture comprising nitric acid and hydrofluoric acid has been used generally. When the acid mixture is used, however,the surface of the steel strip at a state such that not only the crystal intergranular phase but also the crystal intragranular phase is eroded by the acid mixture. Subjecting the steel strip at such state to "skinpass rolling" under a mild pressure, the surface brightness is severely deteriorated, compared with the surface brightness generated by conventional rolling. So as to produce a steel strip with sufficient surface brightness, accordingly, a polishing process has been indispensable after pickling. For the purpose of reducing the burdens of works during the polishing process, conventionally, several proposals have been made as described below.

For example, Japanese Patent Publication No. Sho 62-60164 proposes a technique comprising after cold rolling austenite stainless steel strip, polishing the surface by means of a cloth belt prior to annealing and pickling, and subjecting the resulting steel plate, if necessary, to "skinpass rolling" to prepare a product. However, the technique requires large-scale equipment for surface polishing by means of a cloth belt, which disadvantageously escalates the production cost enormously.

For the purpose of improving the polishing properties of the steel strip surface, for example, Japanese Patent Publication No. Hei 3-60920 proposes to reduce the intergranular eroding by descaling of a hot-rolled annealed steel plate in an acid mixture of given concentrations of nitric acid and hydrofluoric acid. By the technique, however, the surface of the steel plate is so severely solubilized above the necessary level that superficial non-uniformity and irregularity readily develop; and the surface brightness after pickling is not necessarily good. Thus, no improvement is realized as to the requirement of the polishing work.

Additionally, Japanese Patent Laid-open No. Hei 6-280064 discloses a method for improving the polishing properties, by skipping annealing after hot rolling but carrying out annealing and pickling within specific ranges at the finish process to prepare the depth of the pickling-generated micro-groove at 1.0 $\mu$m or less. Even by the method, however, the polishing properties are more or less improved, but the surface brightness of the steel strip after pickling is deteriorated. So as to improve the surface brightness, additional "skinpass rolling" should essentially be enforced.

Still furthermore, Japanese Patent Laid-open No. Hei 6-17271 discloses a technique to improve the polishing properties, comprising of suppressing the depth of the intergranular groove as much as possible by defining the annealing conditions and the concentrations of nitric acid and hydrofluoric acid, thereby preparing the depth of the intergranular groove below 1.0 $\mu$m or less. The method has another problem however in that scale still remains on the surface after pickling and the corrosion resistance is severely deteriorated unless the scale is removed by polishing and the like.

Further, Japanese Patent Laid-open No. Hei 7-113187 discloses a method for promoting the whitening of the surface of a steel strip through pickling in sulfuric acid at a specific concentration, in place of acid mixture composed of nitric acid and hydrofluoric acid. Even by the technique, however, polishing is inevitable for procuring sufficient surface brightness after skinpass rolling, by the definition of the acid concentration, the surface chromium-depleted layer cannot sufficiently be removed, which is disadvantageous because the corrosion resistance after pickling is poorer than the resistance brought about by conventional methods.

From the respect of the improvement of corrosion resistance, still yet furthermore, Japanese Patent Laid-open No. Hei 6-88297 or Japanese Patent Laid-open No. Hei 6-88300 discloses a method for removing the Si-concentrated layer on the steel strip surface, by limiting the pH of a solution for neutral salt electrolysis prior to pickling in an acid mixture or by limiting the electrolytic conditions for nitrate electrolysis after the pickling. Under the limitation of the pH of the solution for neutral salt electrolysis and of the conditions for nitrate electrolysis, the surface is highly solubilized and the intergranular phase in particular can be readily eroded. The corrosion resistance is improved, indeed, but on the contrary, no sufficient surface brightness can be realized, disadvantageously.

As has been described above, all the known techniques described insofar have problems in that polishing is essential after pickling for procuring satisfactory surface brightness in austenite stainless steel and additionally in that the corrosion resistance of the resulting steel strip is unsatisfactory.

SUMMARY OF THE INVENTION

In such circumstances, it is an object of the present invention to provide austenite stainless steel plate having both of excellent surface brightness and superior corrosion resistance,with no requirement of polishing after finish annealing and pickling for descaling.

For the purpose of attaining the object, the present inventors have made detailed investigations about the relationship between following items and surface brightness and corrosion resistance of austenite stainless steel plate;

1) components in austenite stainless steel plate, particularly Si, Al, O, V and Co
2) slab temperature (SRT) at starting time of hot rolling
3) method for removing primary hot-rolled scale and oxides remaining on surface of steel plate
4) present location of oxides
5) various conditions for pickling by means of nitric acid and hydrofluoric acid mixture.

Consequently, the inventors have found that the deterioration of the surface brightness and corrosion resistance after pickling is mainly caused;

a) by preferential intergranular generation of oxides from Si and Al in the steel plate, which oxides deepen or enlarge the intergranular grooves after pickling,
b) or by non-solubilized Si or Al oxides remaining even after pickling.

Then, the inventors have found that the intergranular generation of Si and Al oxides can be suppressed by limiting the components Si, Al and O and by containing appropriate amounts of V and Co in steel slab.

If the generation of Si and Al oxides is reduced along with the reduction of the oxides remaining on the surface of a steel plate, the residual Cr-depleted layer is eliminated thereby improving the corrosion resistance. Furthermore, the inventors have found that hot rolling within a specific range of the slab temperature (SRT) at the starting of hot rolling can suppress the intergranular erosion and surface defects on the hot-rolled plate along with the oxidation of Si and Al, and that high-pressure descaling under given conditions prior to hot rolling can suppress surface defects and mastication on the resulting hot-rolled steel strip, whereby the surface brightness, polishing properties and corrosion resistance of a cold-rolled plate can be improved. The inventors have found that if the concentrations of nitric acid and hydrofluoric acid during pickling after final annealing are individually set within specific ranges, the intragranular and intergranular phases with significant variation in the Cr concentration on the surface of a steel plate can be uniformly solubilized, irrespective of the Cr concentration in the stainless steel plate, and that the solubilizing level via pickling should be modified, depending on the Si concentration therein.

The present invention has been achieved on the basis of the aforementioned findings. The invention is summarized as follows.

1. An austenite stainless steel plate produced through pickling after finish annealing, the steel plate having excellent corrosion resistance and surface brightness and containing Si at 0.2 wt % or less together with Si oxides at 1.0 wt % or less in the surface layer part in the 10-$\mu$m depth from the surface, wherein the depth of the intergranular groove in the surface layer part is from 0.1 $\mu$m or more to 0.5 $\mu$m or less.
2. An austenite stainless steel plate having excellent corrosion resistance and surface brightness, further containing Al of 0.005 wt % or less and O of 0.006 wt % or less, wherein the Al oxides are contained at 0.1 wt % or less in the 10 $\mu$m depth surface layer part.
3. An austenite stainless steel plate having excellent corrosion resistance and surface brightness, further containing one or more selected from the group consisting of V at 0.05 to 0.8 wt % and Co at 0.05 to 0.5 wt %.
4. A method for producing an austenite stainless steel plate, comprising descaling of slab after heating, hot rolling of the slab, annealing of the hot-rolled plate, pickling of the hot-rolled plate, cold rolling of the hot-rolled plate, finish annealing and pickling of the cold-rolled plate, employing slab containing Si of 0.2 wt % or less at the hot-rolling, annealing the cold-rolled plate so that the surface layer part of the 10-$\mu$m depth from the surface of the plate might contain Si oxides at 1.0 wt % or less, solubilizing the surface of the cold-rolled plate at the pickling process after finish annealing in an acid mixture within the range of average solubilized level represented by the following formula, so that the depth of the intergranular groove of the surface layer part might be 0.1 $\mu$m or more to 0.5 $\mu$m or less, $$1.2+3\times E \leqq D \leqq 3.8+2\times E$$

wherein "D" represents the average solubilized level (g/m$^2$) and "E" represents Si concentration (wt %).

5. A method for producing an austenite stainless steel plate, having excellent corrosion resistance and surface brightness, wherein the surface is solubilized by using an acid mixture of nitric acid and hydrofluoric acid of the composition satisfying the range represented by the following formula;

$$10 \leqq A \leqq 70,$$

$$5 \leqq B-0.67\times C \leqq 20,$$

$$C \leqq 50$$

wherein "A" is nitrate concentration (g/l); "B" is hydrofluorate concentration (g/l); and "C" is Fe concentration (g/l) in solvent medium.

6. A method for producing an austenite stainless steel plate having excellent corrosion resistance and surface brightness, wherein the slab temperature at starting time of hot rolling is about 1100° C. to 1200° C.
7. A method for producing an austenite stainless steel plate having excellent corrosion resistance and surface brightness comprising subjecting slab to high-pressure descaling at a water injection pressure of 200 kgf/cm$^2$ or more prior to hot rolling.
8. A method for producing an austenite stainless steel plate having excellent corrosion resistance and surface brightness further containing Al of 0.005 wt % or less and O of 0.006 wt % or less in the steel plate, wherein the Al oxides are contained at 0.1 wt % or less in the 10 μm depth surface layer part of the steel plate.

9. A method for producing an austenite stainless steel plate having excellent corrosion resistance and surface brightness further containing one or more selected from the group of V at 0.05 to 0.8 wt % and Co at 0.05 to 0.5 wt % in the steel plate.

In accordance with the present invention, the austenite stainless steel plate is formed in the form as described above, and therefore, the stainless steel plate can keep good corrosion resistance and surface brightness even without polishing after final annealing and pickling. The present invention will now be described in detail hereinbelow.

DETAILED DESCRIPTION OF THE INVENTION

Figure 1:
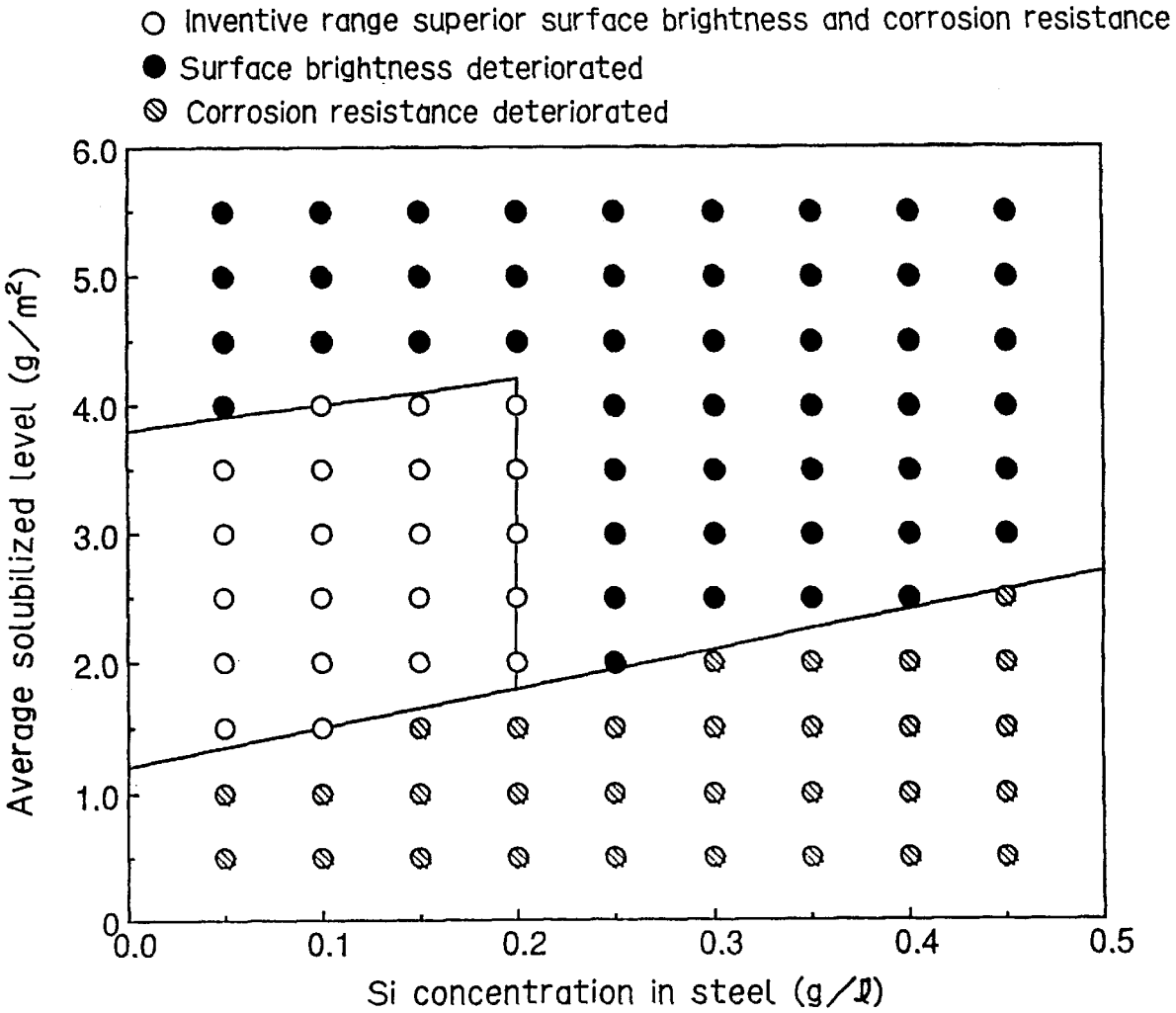
FIG. 1 is a schematic view depicting the relationship between the Si content in the austenite stainless steel plate and the surface brightness and corrosion resistance.

In accordance with the first aspect of the present invention, the Si content in the austenite stainless steel plate is 0.2 wt % or less. In general types of austenite stainless steel plate, Si has been added, as a deoxidizer at about 0.4 to 0.7 wt %, into the molten steel at the steel-making. In accordance with the present invention, however, the content is less than usual as shown above, because the present inventors have found after detailed examination of the Si components in steel and the Si oxides on the steel surface that a higher Si level in the steel causes a higher level of Si oxide deposition in the intergranular phase at the annealing process. The Si oxides, present in the intergranular phase as if the oxides had roots in the phase, suppress the descaling properties of the steel at subsequent pickling process and additionally deepen the intergranular groove on the steel surface, inhibit the growth of crystal particles and have an effect of increasing the number of the intergranular grooves per unit area, whereby the surface brightness and corrosion resistance are severely deteriorated after pickling. In other words, a lower Si content in the steel causes no generation of Si oxides around the intergranular phase on the steel surface during final annealing, decreases the number of the intergranular grooves per unit area on the steel plate surface and also reduces the depth of the intergranular groove, with the resultant improvement of surface brightness. As to the Si upper limit, the inventors have made investigations in detail about the Si content in the steel,the oxides around the intergranular phase, and the surface brightness and corrosion resistance after pickling, and have consequently found that the Si content of 0.2 wt % or less does not severely deteriorate the surface brightness or corrosion resistance. Thus, it is required to regulate the Si content in the austenite stainless steel at 0.2 wt % or less. A lower Si content is better, so no lower limit is not necessarily defined. If the content is too low, however, deoxidizing will be difficult during steel-making or adverse effects on weldability of the steel at the forming will be induced, possibly. Thus, the Si content should preferably be at 0.02 wt % to 0.15 wt %.

Additionally in accordance with the present invention, the Si oxide content should be at 1.0 wt % or less in the components in the 10-μm thickness from the surface after final annealing and pickling. As has been described above, the Si oxides prevent the growth of crystal grains, and increase the area of the intergranular grooves on the steel surface layer and deepen the depth of the intergranular grooves after pickling. Therefore,such Si oxides adversely affect the surface brightness. Unlike other chromium oxides and iron oxides,the Si oxides are hardly soluble in acid and neutral salt solutions, and even after treatments such as pickling, the solubilization of the overall Si oxides on the surface layer cannot be done under general pickling conditions. If the Si oxides remain after pickling, the oxides work as points of rust generation; the residual Si oxides cause the underlying Cr-depleted layer to remain, all of them giving adverse effects on the corrosion resistance. These adverse effects are markedly suppressed by limiting the Si oxides within a range of 1.0 wt % or less in the 10 μm depth from the steel surface. Hence, the Si content within the range of the thickness should be defined as 1.0 wt % or less. Within the range, a lower content of the Si oxides remaining on the steel plate surface is better. As has been described above, however, excess reduction of the Si oxides only through acid solubilization, involves the solubilization of higher levels of the steel in the underlying layer of the Si oxide layer on the steel surface, which deepens the intergranular grooves on the steel plate surface to induce surface brightness reduction. Such damage can be avoided by reducing the Si content in the steel.

In accordance with the present invention, furthermore, the depth of the intergranular grooves (eroded intergranular grooves) on the steel plate surface after pickling following finish annealing, should be 0.1 to 0.5 μm. In the proximity of the intergranular phase of the stainless steel plate after finish annealing, a chromium-depleted layer is generated from the relation with the diffusion rate of Cr. Because the corrosion resistance gets poor in the steel plate of the inventive component, unless the chromium-depleted layer is solubilized through pickling, the chromium-depleted layer should be pickled and removed so that the depth of the intergranular phase on the surface of the steel plate might be at least 0.1 μm. Alternatively, if the intergranular grooves are too deep, the surface brightness may be reduced consequently. So as to procure surface brightness and corrosion resistance together, the depth of the intergranular grooves should be adjusted to 0.1 to 0.5 μm.

In accordance with the second aspect of the present invention, the Al content in the steel is limited at 0.005 wt % or less and the O content at 0.006 wt % or less, in addition to the limitation of the Si content. Far better effects of improving the surface brightness and corrosion resistance can be realized on the same grounds as the definition of the Si content described above. This is because an Al content above 0.005 wt % together with an O content above 0.006 wt % forms Al oxides on the surface and these Al oxides are concentrated in the crystal intergranular phase between the steel and the scale interface to prevent the crystal grain growth, increase the number of the intergranular grooves per unit area, deepen the depth of the intergranular grooves after pickling and deteriorate the surface brightness of the steel strip. In other words, the regulation of Al and O in the steel does not cause any Al oxide generated, resulting in the improved surface brightness. Lower Al and O levels might be better, but if the levels are too low, the refining time during steel-making is prolonged, involving cost up. Therefore, Al should be at 0.005 wt % or less, while O should be at 0.006 wt %. Preferably, furthermore,Al should be at 0.003 wt % or less, while O should be at 0.006 wt % or less.

In accordance with the present invention, additionally, the Al oxides in the components in the 10 μm-depth from the surface after final annealing and pickling should be at 0.1 wt % or less. As has been described above, Al oxides prevent the growth of the crystal grain, increase the area of the intergranular grooves on the steel surface layer and also increase the depth of the intergranular grooves after pickling. From the respect of surface brightness, therefore, adverse effects may be brought about. Unlike other chromium andiron oxides, Al oxides are hardly soluble in acids or neutral salt solutions, and even after treatments including pickling, the Al oxides on the surface layer cannot entirely be solubilized under conventional pickling conditions. If these Al oxides remain after pickling, the oxides work as points of rust generation. The residual Al oxides may cause the underlying chromium-depleted layer to remain, all of them giving adverse effects on the corrosion resistance. These effects are markedly suppressed by limiting the Al oxides within a range of 0.1 wt % or less in the 10-μm depth from the steel surface. Hence, the Al content within the range of the thickness should be defined as 0.1 wt % or less. Within the range, a lower content of the Al oxides remaining on the steel plate surface is better. As has been described above, however, excess reduction of the Al oxides only through acid solubilization, involves the solubilization of higher levels of the steel in the underlying layer of the Al oxide layer on the steel surface, which deepens the intergranular grooves on the steel plate surface to induce surface brightness reduction. Such damage can be avoided by reducing the Al content and O content in the steel.

In accordance with the third aspect of the present invention, furthermore, the V content and the Co content in the austenite steel should be 0.05 wt % to 0.8 wt % and 0.05 wt % to 0.5 wt % respectively. This definition is derived from the finding that after detailed investigations of elements capable of suppressing the Si oxides and Al oxides generated in the intergranular phase, V and Co are effective as such element.

When V is added into the steel, V nitrides are generated in the intergranular phase during annealing. The reaction rate of the generation reaction is faster than the generation rate of the Si oxides and Al oxides, which serves to prevent generation of Si oxides at a higher density in the intergranular phase or which is effective for preventing the diffusion of Si and Al into the intergranular phase. Thus, an appropriate amount of V added into steel can suppress the generation of Si oxides and Al oxides into the intergranular phase, and the generation deterioratesthe surface brightness and corrosion resistance after pickling. Because V of 0.05 wt % or more is effective for suppressing oxides, the lower limit should be 0.05 wt %. A higher V level is better so as to suppress the generation of Si oxides and Al oxides, but excess addition of V may cause the austenite crystal grains into finer particles or may cause the generation of $V_2O_5$ which deteriorates the corrosion resistance on the surface. Thus, the upper limit of V should be 0.8 wt %. Preferably, furthermore, the V in the steel should be at 0.1 wt % to 0.5 wt %.

In the other hands, Co in the austenite steel functions to prevent the oxidation of Si and Al, and suppresses the generation of Si and Al oxides in the intergranular phase. After detailed investigations, it has been found that Co at 0.05 wt % or more works to effectively prevent the oxides in the intergranular phase. Thus, the lower limit should be 0.05 wt % Furthermore, the effects of Co are saturated around 0.5 wt %, and excess addition of Co may induce cost up. Thus, the Co upperlimit should be 0.5 wt %. Preferably, furthermore,the Co in the steel should be at 0.05 wt % to 0.3 wt %.

Next, Explanation will be continued about the method for producing the above mentioned austenite stainless steel plate. Generally, austenite stainless steel plate is produced by employing steel slab through descaling by high pressure water, hot-rolling, cold-rolling, heat treatment and pickling. The steel slab is made of molten steel of which component elements is adjusted in steel-making process and casted in a continuous casting machine. Further, after finish pickling of the plate, "skinpass rolling" is carried out to increase the surface brightness of the plate.

At First, in accordance with the fourth aspect of the present invention, the austenite stainless steel plate after cold rolling should be pickled after final annealing, by using nitric acid and hydrofluoric acid, both satisfying the range of the following formula;

$$1.2+3\times E \leqq D \leqq 3.8+2\times E$$

wherein "D" represents the average solubilized level ($g/m^2$) and "E" represents Si concentration (wt %)

The present inventors have made detailed investigations and experiments about the relationship between the average solubilized level required by the pickling and the surface brightness and corrosion resistance. The results are shown in the schematic view of FIG. 1. As apparently shown in FIG. 1, if the average solubilized level during the pickling is less than the value of 1.2+3×Si (wt %), surface scale cannot completely be removed, so that it is indicated that the Si oxides remain also in the intergranular phase and deteriorate the corrosion resistance. If the average solubilized level is above the value of 3.8+2×Si (wt %), the intergranular groove is deepened and widened, which apparently deteriorates the surface brightness.

In accordance with the fifth aspect of the present invention, additionally, the austenite stainless steel plate after cold rolling should be pickled after finish annealing, by using nitric acid and hydrofluoric acid, both satisfying the range represented by the following formula;

$$10 \leqq A \leqq 70,$$

$$5 \leqq B-0.67\times C \leqq 20,$$

$$C \leqq 50$$

wherein "A" is nitrate concentration (g/l); "B" is hydrofluorate concentration (g/l); and "C" is Fe concentration (g/l) in solvent medium.

If the nitric acid concentration is below 10 g/l the solubilization ability is so poor that the descaling requires a far longer time. If the concentration is above 70 g/l, the solubilization of steel is so high that erosion in a pit form occurs not only in the intergranular phase but also in the intragranular phase, which deteriorates the surface brightness. Thus, the nitric acid concentration should be 10 g/l to 70 g/l. If the formula B-0.67 C representing the relationship between the hydrofluoric acid and the steel concentration has a value smaller than 5, the solubilizing potency is so poor that the descaling requires a far longer time. If the value of the formula B-0.67 C is larger than 20, the solubilizing level more strongly depends on the Cr concentration. Therefore, the intergranular phase with a chromium-depleted layer developed therein is so selectively solubilized primarily that the depth and width of the intergranular groove are so enlarged, resulting in no uniform solubilization of the surface. If the relation formula between the hydrofluoric acid and the steel concentration is within the inventive range, adversely, the solubilizing level less depends on the Cr concentration, resulting in uniform solubilization of the surface and improved brightness. Therefore, the relationship between the hydrofluoric acid and the steel concentration should be represented by $5 \leqq B-0.67 \times C \leqq 20$. If the steel concentration in the pickling solution is above 50 g/l furthermore, the descaling gets tough to cause a vast amount of precipitates on the bottom of an pickling tank. From the respect of the disposal of the pickling waste, the operation would be hard. Therefore, the upper limit should be 50 g/l.

In the sixth aspect of the present invention, wherein the slab temperature (referred to as "SRT" hereinafter) at the starting of hot rolling should be within a range of 1100° C. to 1200° C. The reason is as follows. If SRT is above 1200° C., thicker hot-rolled scale, for example Si oxides and Al oxides generates on the surface of the steel slab. A larger thickness of these oxides, namely hot-rolled scale, causes crude rolling; in other words, hot-rolled scale is pushed in during the finish rolling to cause damage on the surface of the steel plate and the generation of masticated scale. Such damages remain after pickling following hot rolling and still remain even after cold rolling, which are then left as larger damages on the surface of the plate after finish annealing and pickling, with the resulting surface brightness deterioration. More specifically, SRT below 1200° C. generates thinner hot-rolled scale on the surface of the steel plate, with no mastication on to the surface during hot rolling, so that the occurrence of damages and patterns is suppressed to improve the surface brightness of the cold-rolled plate. Thus, the SRT should be 1200° C. or less during hot rolling. A lower SRT is better, but if the SRT is too low, the steel plate is not softened to require a far higher level of loads for rolling out, with the resultant hard operation. Therefore, the SRT should be 1100° C. to 1200° C. during hot rolling.

In the seventh aspect of the present invention, the austenite stainless steel plate should additionally be subjected to high-pressure descaling at a water injection pressure of 200 kgf/cm$^2$ or more after heating of the steel slab during hot rolling and prior to roughing rolling. This is because the steel slab with hot-rolled scale generated during heating, if the steel slab is rolled, makes the hot-rolled scale pushed in during hot rolling to cause damages and masticated scale on the surface of the steel plate, which deteriorate the surface brightness after final annealing and pickling. In other words, if the hot-rolled scale is peeled off at some extent after heating of the steel slab and prior to rolling, no mastication or the like occurs. Thus, the finally annealed and pickled plate can procure good brightness. The present inventors have examined a variety of descaling processes of the austenite stainless steel slab of the inventive composition, to find that the descaling process by means of high-pressure water is the most appropriate. The inventors have found that no damage such as mastication or pattern develops at a water injection pressure above 200 kgf/cm$^2$ or more. In accordance with the seventh of the present invention, thus, high-pressure descaling should be carried out at a water injection pressure of 200 kgf/cm$^2$ or more, prior to rolling and after heating of the steel slab during hot rolling.

The explanation about the eighth and ninth aspect of the present invention are abbreviated because they can be easily understood on the basis of the above mentioned explanation of the 2nd and 3rd invention.

In accordance with the present invention, the temperature of the final annealing may satisfactorily be determined, depending on the diameter of crystal grains and mechanical properties and the like. Therefore, in accordance with the present invention, the temperature is with no specific limitation. However, the temperature is preferably about 1000° C. to 1150° C., from the respect of the relation with re-crystallization temperature. As the pretreatment for picking with an acid mixture, the aforementioned conventionally selected pretreatment with an alkali molten salt or the electrolytic pretreatment with a neutral salt including an aqueous $Na_2SO_4$ solution, similarly conventionally employed, may satisfactorily be carried out. Still additionally, in accordance with the present invention, it is needless to say that treatment such as nitrate electrolysis and "skinpass rolling" may be carried out satisfactorily after treatment with an acid mixture. The solubilization level with an acid mixture may be adjusted by appropriately selecting the immersion time and temperature and the like. Additionally, other components besides the aforementioned components in the steel plate are not necessarily defined. The components in the conventional austenite steel may satisfactorily be applicable as they are.

EXAMPLE 1

By melting austenite stainless steel having compositions as shown in Table 1-1, Table 1-2 into ingots at a laboratory scale, subjecting the ingots to high-pressure descaling at SRT 1180° C. and a water injection pressure of 250 kgf/cm$^2$ prior to hot rolling, hot-rolled plates of a plate thickness of 4.0 mm were prepared. Subsequently annealing and pickling the plates prior to cold rolling, cold-rolled plates of a plate thickness of 1.0 mm were prepared. After thermal treatment (annealing) at 1100° C. for 30 sec, in combustive gas containing 3 vol. % $O_2$, 7 vol. % $CO_2$, 20 vol. % moisture and 70 vol. % $N_2$, then, electrolytic pretreatment with a neutral salt (200 g/l $Na_2SO_4$, a temperature of 80° C., and an electrolytic current of 120 C/dm$^2$) was conducted on the plates, which were then immersed in an acid mixture of 50 g/l nitric acid, 35 g/l hydrofluoric acid and 30 g/l Fe and at a temperature of 60° C. to solubilize the surface at 3 g/m$^2$ on average. The concentrations of the Si oxides and Al oxides in the depth of 10 $\mu$m from the surface were determined in the extracted residues thereof.

The determination was carried out by electrolyzing a 10 cm square sample of each of the pickling plates in a bromine-methanol solution to solubilize the surface layer down into the 10 $\mu$m depth and analyzing the solubilized level and the weight of the residue. The oxides in the residue were identified by X-ray diffraction, and Fourier transform infra-red spectrometry, while the Si and Al contents in the residue were determined by wet analysis. The depth of the intergranular groove on the steel plate surface was measured under observation with SEM and a laser microscope.

The surface brightness and corrosion resistance of the resulting steel plates were evaluated. The surface brightness was evaluated on the basis of the brightness according to JIS Z 8741. Also, the corrosion resistance was determined by the rust developing area ratio after 240 hours according to the so-called CAS test (JIS D 0201).

Table 1-1 and Table 1-2 demonstrate that the levels of the Si component outside the inventive range cause poor surface brightness and poor corrosion resistance. The crystal granularity on the steel surface and the width of the intergranular groove, outside the inventive range, cause deteriorated surface brightness. On the contrary, the examples of the present invention have better surface brightness and corrosion resistance than those of conventional examples.

The levels of the Al, O, V and Co components within the inventive range improve further the surface brightness.

EXAMPLE 2

By melting austenite stainless steel having compositions as shown in Table 2 into ingots at a laboratory scale, subjecting the ingots to the high-pressure descaling at the SRT as shown in Table 3, and then subjecting the resulting ingots to hot rolling, hot-rolled plates of a plate thickness of 4.0 mm were prepared. Subsequently annealing and pickling the plates prior to cold rolling, cold-rolled plates of a plate thickness of 1.0 mm were prepared. After thermal treatment at 1100° C. for 30 sec, in combustive gas containing 3 vol. % $O_2$, 7 vol. % $CO_2$, 20 vol. % moisture and 70 vol. % $N_2$, then, electrolytic treatment with a neutral salt (200 g/l $Na_2SO_4$, a temperature of 80° C., and an electrolytic current of 120 C/dm$^2$) was conducted on the plates, which were then immersed in an acid mixture of 50 g/l nitric acid, 35 g/l hydrofluoric acid and 30 g/l Fe and at a temperature of 60° C., to solubilize the surface at 3 g/m$^2$ on average. The concentrations of the Si oxides and Al oxides in the depth of 10 $\mu$m from the surface and the depth of the intergranular groove were determined in the same manner as shown in Example 1. The surface brightness and corrosion resistance of the resulting steel plates were evaluated also in the same manner as shown in Example 1.

Table 3 demonstrates that the SRT levels within the inventive range improve further the surface brightness. If high-pressure descaling is carried out under conditions within the inventive range prior to rolling, the surface brightness is further improved.

EXAMPLE 3

By melting austenite stainless steel having compositions as shown in Table 4 into ingots at a laboratory scale, maintaining the ingots at an SRT of 1180° C. for one hour and subjecting the resulting ingots to high-pressure descaling at a water injection pressure of 250 kgf/cm$^2$ prior to hot rolling, hot-rolled plates of a plate thickness of 4.0 mm were prepared. Subsequently annealing and pickling the plates prior to cold rolling, cold-rolled plates of a plate thickness of 1.0 mm were prepared. After thermal treatment at 1100° C. for 30 sec, in combustive gas containing 3 vol. % $O_2$, 7 vol. % $CO_2$, 20 vol. % moisture and 70 vol. % $N_2$, then, electrolytic pretreatment with a neutral salt (200 g/l $Na_2SO_4$, a temperature of 80° C., and an electrolytic current of 120 C/dm$^2$) was conducted on the plates, which were then immersed in an acid mixture under conditions as shown in Table 5, to solubilize the surface at the level on average as shown in Table 5. The concentrations of the Si oxides and Al oxides in the depth of 10 $\mu$m from the surface and the depth of the intergranular groove were determined in the same manner as in Example 1. The surface brightness and corrosion resistance of the resulting steel plates were evaluated in the same manner as shown in Example 1.

Table 5 demonstrates that the compositions of the acid mixtures and the average solubilized levels, outside the ranges according to the present invention, have both good surface brightness and corrosion resistance, indeed, compared with the conventional examples shown in Table 1, and that the compositions and the average solubilized levels within the inventive ranges can procure far better surface brightness.

As apparently shown in the individual Examples, the Si content in austenite stainless steel plate, the Si oxide content in the 10 $\mu$m depth from the surface and the depth of the intergranular groove,all satisfying the inventive ranges, together with the concentrations of the Al, O, V and Co in the steel satisfying the inventive ranges can produce a stainless steel plate with superior surface brightness and corrosion resistance.

TABLE 1

| Experimental No. | C | Si | Mn | P | S | Cr | Ni | Co | V | Al | N | O | Cu (wt %) | Si Concentration in 10 μm Surface layer (wt %) | Al Concentration in 10 μm Surface layer (wt %) | Depth of intergranular groove (in μm) | Surface brightness (G 20) | Rusted area (%) | Note |
|---|---|---|---|---|---|---|---|---|---|---|---|---|---|---|---|---|---|---|---|
| 1 | 0.051 | 0.12 | 1.02 | 0.032 | 0.006 | 18.2 | 8.95 | 0.10 | 0.12 | | | | — | 0.40 | 0.03 | 0.25 | 980 | 0 | Inventive example |
| 2 | 0.051 | 0.15 | 1.01 | 0.031 | 0.007 | 18.6 | 8.31 | 0.12 | 0.11 | 0.002 | 0.037 | 0.005 | 0.31 | 0.50 | 0.01 | 0.35 | 965 | 0 | Inventive example |
| 3 | 0.052 | 0.2 | 0.98 | 0.031 | 0.007 | 18.2 | 8.78 | 0.08 | 0.35 | 0.005 | 0.039 | 0.003 | — | 0.70 | 0.07 | 0.20 | 998 | 2 | Inventive example |
| 4 | 0.053 | 0.1 | 1.03 | 0.032 | 0.006 | 18.3 | 8.97 | 0.35 | 0.05 | 0.004 | 0.037 | 0.005 | 0.3 | 0.60 | 0.03 | 0.45 | 970 | 1 | Inventive example |
| 5 | 0.048 | 0.12 | 0.59 | 0.033 | 0.007 | 18.4 | 9.02 | 0.20 | 0.15 | 0.001 | 0.041 | 0.003 | — | 0.50 | 0.04 | 0.50 | 980 | 0 | Inventive example |
| 6 | 0.051 | 0.08 | 0.99 | 0.027 | 0.003 | 18.1 | 8.76 | 0.15 | 0.13 | 0.005 | 0.043 | 0.002 | 0.31 | 0.30 | 0.05 | 0.35 | 965 | 3 | Inventive example |
| 7 | 0.053 | 0.02 | 1.01 | 0.029 | 0.004 | 18.2 | 8.55 | 0.08 | 0.26 | 0.003 | 0.033 | 0.003 | — | 0.20 | 0.07 | 0.25 | 975 | 1 | Inventive example |
| 8 | 0.048 | 0.16 | 1.34 | 0.036 | 0.005 | 18.3 | 8.75 | 0.25 | 0.18 | 0.004 | 0.025 | 0.008 | 0.35 | 0.60 | 0.06 | 0.15 | 985 | 2 | Inventive example |
| 9 | 0.025 | 0.17 | 1.01 | 0.042 | 0.005 | 18.2 | 9.12 | 0.30 | 0.08 | 0.002 | 0.038 | 0.004 | — | 0.70 | 0.08 | 0.10 | 955 | 4 | Inventive example |
| 10 | 0.050 | 0.12 | 1.03 | 0.033 | 0.006 | 18.2 | 8.31 | 0.18 | 0.16 | 0.005 | 0.0038 | 0.003 | 0.3 | 0.80 | 0.03 | 0.35 | 980 | 3 | Inventive example |
| 11 | 0.051 | 0.15 | 1.01 | 0.031 | 0.007 | 18.6 | 8.31 | 0.19 | 0.12 | 0.002 | 0.037 | 0.005 | — | 0.20 | 0.03 | 0.25 | 970 | 4 | Inventive example |
| 12 | 0.052 | 0.08 | 0.98 | 0.032 | 0.006 | 18.1 | 8.45 | 0.24 | 0.10 | 0.004 | 0.036 | 0.007 | 0.29 | 0.30 | 0.04 | 0.40 | 960 | 1 | Inventive example |
| 13 | 0.053 | 0.12 | 1.24 | 0.032 | 0.006 | 16.8 | 10.62 | 0.32 | 0.11 | 0.002 | 0.038 | 0.005 | — | 0.60 | 0.07 | 0.35 | 950 | 0 | Inventive example |
| 14 | 0.049 | 0.18 | 1.12 | 0.034 | 0.003 | 16.2 | 9.35 | 0.26 | 0.16 | 0.003 | 0.029 | 0.004 | 0.3 | 0.70 | 0.02 | 0.35 | 985 | 2 | Inventive example |
| 15 | 0.051 | 0.15 | 1.02 | 0.032 | 0.006 | 18.2 | 8.95 | 0.10 | 0.12 | 0.002 | 0.038 | 0.004 | — | 0.60 | 0.03 | 0.45 | 965 | 0 | Inventive example |

TABLE 1-continued

| Experimental No. | C | Si | Mn | P | S | Cr | Ni | Co | V | Al | N | O | Cu (wt %) | Si Concentration in 10 μm Surface layer (wt %) | Al Concentration in 10 μm Surface layer (wt %) | Depth of intergranular groove (in μm) | Surface brightness (G 20) | Rusted area (%) | Note |
|---|---|---|---|---|---|---|---|---|---|---|---|---|---|---|---|---|---|---|---|
| 16 | 0.051 | 0.18 | 1.01 | 0.031 | 0.007 | 18.6 | 8.31 | 0.12 | 0.11 | 0.002 | 0.037 | 0.005 | 0.31 | 0.30 | 0.01 | 0.50 | 975 | 2 | Inventive example |
| 17 | 0.048 | 0.12 | 0.59 | 0.033 | 0.007 | 18.4 | 9.02 | 0.20 | 0.15 | 0.007 | 0.041 | 0.012 | — | 0.40 | 0.12 | 0.25 | 655 | 4 | Inventive example |
| 18 | 0.051 | 0.08 | 0.99 | 0.027 | 0.003 | 18.1 | 8.76 | 0.15 | 0.13 | 0.011 | 0.043 | 0.011 | 0.31 | 0.35 | 0.18 | 0.35 | 685 | 3 | Inventive example |
| 19 | 0.053 | 0.02 | 1.01 | 0.029 | 0.004 | 18.2 | 8.55 | 0.08 | 0.02 | 0.003 | 0.033 | 0.012 | — | 0.80 | 0.09 | 0.20 | 605 | 3 | Inventive example |
| 20 | 0.048 | 0.16 | 1.34 | 0.036 | 0.005 | 18.3 | 8.75 | 0.03 | 0.18 | 0.004 | 0.025 | 0.015 | 0.35 | 0.90 | 0.08 | 0.15 | 695 | 5 | Inventive example |
| 21 | 0.025 | 0.52 | 1.01 | 0.042 | 0.005 | 18.2 | 9.12 | — | 0.03 | 0.008 | 0.038 | 0.012 | — | 1.20 | 0.15 | 0.10 | 50 | 26 | Comparative example |
| 22 | 0.050 | 0.25 | 1.03 | 0.033 | 0.006 | 18.2 | 8.31 | — | 0.90 | 0.006 | 0.038 | 0.006 | 0.3 | 1.20 | 0.12 | 0.50 | 20 | 45 | Comparative example |
| 23 | 0.051 | 0.53 | 1.01 | 0.031 | 0.007 | 18.6 | 8.95 | 0.15 | 0.08 | 0.006 | 0.037 | 0.008 | — | 1.30 | 0.13 | 0.25 | 30 | 25 | Comparative example |
| 24 | 0.052 | 0.55 | 0.98 | 0.032 | 0.006 | 18.1 | 8.31 | 0.30 | 0.01 | 0.007 | 0.036 | 0.011 | 0.29 | 1.25 | 0.08 | 0.35 | 20 | 26 | Comparative example |
| 25 | 0.053 | 0.35 | 1.24 | 0.032 | 0.006 | 18.4 | 9.02 | — | 0.85 | 0.008 | 0.038 | 0.016 | — | 1.10 | 0.12 | 0.80 | 20 | 18 | Comparative example |
| 26 | 0.049 | 0.28 | 1.12 | 0.034 | 0.003 | 18.1 | 8.76 | — | 0.03 | 0.011 | 0.029 | 0.008 | 0.3 | 1.10 | 0.15 | 0.45 | 20 | 16 | Comparative example |

TABLE 2

| Chemical components in wt % of subject materials | | | | | | |
|---|---|---|---|---|---|---|
| C | Si | Mn | P | S | Cr | Ni |
| 0.051 | 0.19 | 1.02 | 0.032 | 0.006 | 18.2 | 8.95 |
| Co | V | Al | Cu | N | O | |
| 0.12 | 0.11 | 0.003 | 0.3 | 0.038 | 0.005 | |

TABLE 3

| Experimental Results | | | | | | | | |
|---|---|---|---|---|---|---|---|---|
| Experimental No. | SRT ° C. | Descaling Conditions Kgf/cm$^2$ | Si concentration in 10 $\mu$m surface layer | Al concentration in 10 $\mu$m surface layer | Depth of intergranular groove $\mu$m | Surface brightness (G20) | Rusted area (%) | Note |
| 27 | 1180 | 250 | 0.5 | 0.07 | 0.20 | 990 | 3 | Inventive Example |
| 28 | 1190 | 350 | 0.3 | 0.03 | 0.45 | 980 | 3 | Inventive Example |
| 29 | 1130 | 300 | 0.2 | 0.04 | 0.50 | 960 | 2 | Inventive Example |
| 30 | 1145 | 280 | 0.6 | 0.05 | 0.35 | 950 | 3 | Inventive Example |
| 31 | 1170 | 270 | 0.7 | 0.07 | 0.25 | 930 | 5 | Inventive Example |
| 32 | 1160 | 270 | 0.8 | 0.06 | 0.15 | 920 | 0 | Inventive Example |
| 33 | 1150 | 290 | 0.2 | 0.08 | 0.10 | 930 | 4 | Inventive Example |
| 34 | 1180 | 360 | 0.3 | 0.03 | 0.35 | 950 | 2 | Inventive Example |
| 35 | 1220 | No descaling | 0.6 | 0.03 | 0.25 | 655 | 6 | Inventive Example |
| 36 | 1250 | No descaling | 0.7 | 0.04 | 0.40 | 650 | 5 | Inventive Example |
| 37 | 1230 | 260 | 0.6 | 0.07 | 0.35 | 705 | 7 | Inventive Example |
| 38 | 1180 | No descaling | 0.3 | 0.05 | 0.25 | 725 | 8 | Inventive Example |

TABLE 4

| Chemical components in wt % of subject materials | | | | | | |
|---|---|---|---|---|---|---|
| C | Si | Mn | P | S | Cr | Ni |
| 0.051 | 0.19 | 1.02 | 0.032 | 0.006 | 18.2 | 8.95 |
| Co | V | Al | Cu | N | O | |
| 0.12 | 0.11 | 0.003 | 0.3 | 0.038 | 0.005 | |

TABLE 5

| | Experimental Results | | | | | | | | | |
|---|---|---|---|---|---|---|---|---|---|---|
| | Acid mixture washing | | | | | | | | | |
| Experimental No. | Nitric acid concentration (g/l) | Hydrofluoric acid concentration (g/l) | Fe concentration (g/l) | Solbilized level g/cm$^2$ | Si concentration in 10 μm surface layer | Al concentration in 10 μm surface layer | Depth of intergranular groove (μm) | Surface brightness (G20) | Rusted area (%) | Note |
| 39 | 55 | 35 | 30 | 1.8 | 0.7 | 0.07 | 0.35 | 965 | 3 | Inventive Example |
| 40 | 60 | 40 | 40 | 2.2 | 0.6 | 0.03 | 0.20 | 998 | 2 | Inventive Example |
| 41 | 25 | 20 | 20 | 2.5 | 0.5 | 0.04 | 0.45 | 970 | 5 | Inventive Example |
| 42 | 65 | 20 | 5 | 3.5 | 0.3 | 0.05 | 0.50 | 980 | 6 | Inventive Example |
| 43 | 40 | 15 | 10 | 3.8 | 0.2 | 0.07 | 0.35 | 965 | 4 | Inventive Example |
| 44 | 45 | 30 | 15 | 3.2 | 0.6 | 0.06 | 0.25 | 975 | 2 | Inventive Example |
| 45 | 50 | 35 | 25 | 4.1 | 0.7 | 0.08 | 0.15 | 985 | 5 | Inventive Example |
| 46 | 45 | 40 | 35 | 2.8 | 0.8 | 0.03 | 0.10 | 955 | 1 | Inventive Example |
| 47 | 80 | 50 | 25 | 2.5 | 0.3 | 0.07 | 0.08 | 70 | 4 | Comparative Example |
| 48 | 55 | 10 | 30 | 1.0 | 1.5 | 0.18 | 0.02 | 960 | 46 | Comparative Example |
| 49 | 55 | 25 | 25 | 9.5 | 0.2 | 0.02 | 0.90 | 60 | 0 | Comparative Example |
| 50 | 45 | 30 | 10 | 1.0 | 1.3 | 0.12 | 0.30 | 980 | 52 | Comparative Example |

What is claimed is:

1. A method for producing an austenite stainless steel plate, comprising descaling of slab after heating, hot rolling of the slab, annealing of the hot-rolled plate, pickling of the hot-rolled plate, cold rolling of the hot-rolled plate, finish annealing and pickling of the cold-rolled plate, employing slab containing Si of 0.2 wt % or less at the hot-rolling, finish annealing the cold-rolled plate so that the surface layer part of the 10 μm depth from the surface of the plate after pickling contains Si oxides at 1.0 wt % or less, solubilizing the surface of the cold-rolled plate at the pickling process after finish annealing in an acid mixture within the range of average solubilized weight loss represented by the following formula, so that the depth of the intergranular groove of the surface layer part might be 0.1 μm or more to 0.5 μm or less, $$1.2+3\times E \leqq D \leqq 3.8+2\times E$$

wherein "D" represents the average solubilized level (g/m$^2$) and "E" represents Si concentration (wt %).

2. A method for producing an austenite stainless steel plate having excellent corrosion resistance and surface brightness according to claim 1, wherein the surface is solubilized by using an acid mixture of nitric acid and hydrofluoric acid of the composition satisfying the range represented by the following formula;

$$10 \leqq A \leqq 70$$

$$5 \leqq B-0.67\times C \leqq 20$$

$$C \leqq 50$$

wherein "A" is nitrate concentration (g/l); "B" is hydrofluorate concentration (g/l); and "C" is Fe concentration (g/l) in solvent medium.

3. A method for producing an austenite stainless steel plate having excellent corrosion resistance and surface brightness according to claim 1, wherein the slab temperature at starting time of hot rolling is about 1100° C. to 1200° C.

4. A method for producing an austenite stainless steel plate having excellent corrosion resistance and surface brightness according to claim 1, comprising subjecting slab to high-pressure descaling at a water injection pressure of 200 kgf/cm$^2$ or more prior to hot rolling.

5. A method for producing an austenite stainless steel plate having excellent corrosion resistance and surface brightness according to claim 1, further containing Al of 0.005 wt % or less and O of 0.006 wt % or less in the steel plate, wherein the Al oxides are contained at 0.1 wt % or less in the surface layer part of the steel plate.

6. A method for producing an austenite stainless steel plate having excellent corrosion resistance and surface brightness according to claim 1, further containing one or more selected from the group of V at 0.05 to 0.8 wt % and Co at 0.05 to 0.5 wt % in the steel plate.

* * * * *